US006354751B1

(12) United States Patent
Franco et al.

(10) Patent No.: US 6,354,751 B1
(45) Date of Patent: Mar. 12, 2002

(54) DEVICE FOR THE CHEMICAL WET TREATMENT OF PHOTOGRAPHIC MATERIAL

(75) Inventors: Fracas Franco; Scodellaro Eni, both of Pordenone (IT)

(73) Assignee: San Marco Imaging S.R.L., Fiume Veneto (IT)

( * ) Notice: Subject to any disclaimer, the term of this patent is extended or adjusted under 35 U.S.C. 154(b) by 0 days.

(21) Appl. No.: 09/504,618

(22) Filed: Feb. 15, 2000

(51) Int. Cl.[7] ..... G03D 3/02
(52) U.S. Cl. ..... 396/626
(58) Field of Search ..... 396/626, 636; 355/27–29; 137/563

(56) References Cited

U.S. PATENT DOCUMENTS 5,307,107 * 4/1994 Nozawa et al. ..... 396/626
5,581,322 * 12/1996 Fyson ..... 396/578

* cited by examiner

*Primary Examiner*—D Rutledge
(74) *Attorney, Agent, or Firm*—Wenderoth, Lind & Ponack, L.L.P.

(57) ABSTRACT

Device for processing photographic material comprising a plurality of treating baths (1–9) containing developing, bleaching, fixing and stabilizing solutions. During the working operations, the treating baths are successively crossed by the photographic material to be treated. The refilling of the treating baths is obtained by means of pumps (41–47) and pipes (31–37) which draw the treating solutions from each restoring container (11–13) as well as the treating water from a water-reservoir (24). A driving device (50) of the refilling pumps cooperates with the level sensors (S1–S6) of the restoring containers in order to stop the refilling process and to actuate an auxiliary pump (71–73) as soon as one of the restoring containers is empty. The auxiliary pump (71–73) removes the residual treating solutions from the restoring containers through an additional pipe (61–63) connected with each restoring container (11–13). The device according to the invention facilitates the maintenance operations and makes simple and economical the disposal of the restoring containers.

10 Claims, 1 Drawing Sheet

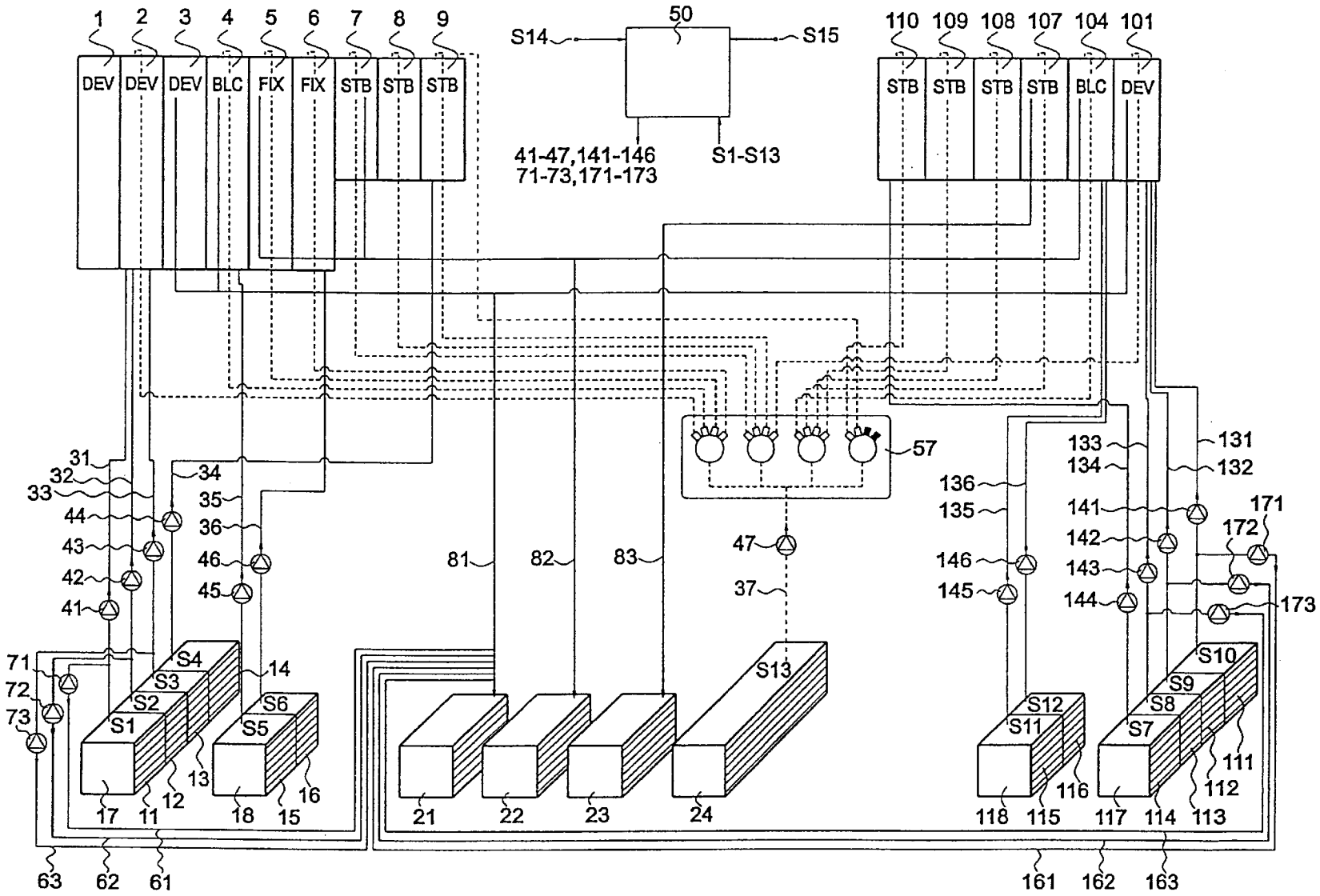
DEV
BLC
STB
FIX
S1-S13
S14
S15
41-47,141-146
71-73,171-173

DEVICE FOR THE CHEMICAL WET TREATMENT OF PHOTOGRAPHIC MATERIAL

DESCRIPTION

The invention relates to a device for the chemical wet treatment of photographic material according to the inventive concept stated in the independent claim.

This kind of photographical treating devices are usually called processors (film-processors, paper-processors). A large number of photo finishing apparatuses, in particular the apparatuses named as Minilabs, include either a film-processor or a paper-processor.

Such a processor comprises a series of treating baths which are successively crossed by the photographic material, film or paper, to be treated.

Usually, there are one or more developing baths, a bleaching bath, one or more fixing baths and one or more stabilizing baths which, during the working operation of the processor, contain respective developing solutions, bleaching solutions, fixing solutions and stabilizing solutions which are suitable for the photographic material to be treated.

The number of the baths changes according to the photographic material and to the respective chemical system. In any case, there are one or more developing and bleaching baths.

The treating solutions are subject to consumption according to the output per hour in treated material and therefore they need to be restored in a continuous way or by request. For this purpose, the processor comprises restoring containers which can be replaced and which are connected with the treating baths by means of pumps and pipes in order to restore every treating solution.

A driving device of the pumps operates in such a way as the restoring containers refill adequately each treating solution in each treating bath.

It appears obvious that the empty restoring containers must be opportunely replaced with full restoring containers involving in expenditure on maintenance.

In order to facilitate and to quicken the managing of the restoring containers it was recently introduced into use an organizing method that provides to supply the chemical treating solutions inside plastic containers housed within cardboard casings.

Generally, one of the cardboard casings houses the containers for three developing solutions and for the stabilizing solution while the other cardboard casing houses the containers for the bleaching and the fixing solutions or for a combined bleaching-fixing solution.

According to the above-mentioned organizing method, the chemical system and, in a conforming way, the consumption of the treating solutions, the single plastic containers and the treating solutions holded therein, are synchronized one another in such a way that, as a rule, all the plastic containers, or better, all the cardboard casings should empty in the meantime supposing that the flow rates of the pumps should have been correspondingly adapted.

Level sensors, for example made of electrical contacts, are provided in the plastic containers, or also in their cardboard casings, in order to transmit a signal to their driving devices as soon as one of the containers is empty.

According to the above described method, the maintenance operations are substantially simpler than those required by the previous methods because the restoring containers can be replaced in the meantime requiring only the replacement of two casings containing all the treating solutions.

Moreover, also the disposal of the empty cardboard casings is considerably simpler because there are quantities of residual treating solutions so negligible that the casings and the restoring containers can be disposed only after a simple sorting of the plastic containers from the cardboard casings On the other hand, this method involves a lot of practical difficulties.

In fact, it often happens that all the containers do not empty in the meantime because the used pumps are not sufficiently accurate and the suction forces required to draw the treating solutions from their containers are varying from cardboard casing to card-board casing.

But, if one of the containers has emptied before the others, this method involves also the replacement of all remaining containers or casings.

Apart from the waste of not used treating solutions, this fact makes the disposal of the casings more difficult and expensive because their residual contents are dangerous for the environment. In addition, this method does not ensure the correct refilling of the treating baths and this can cause negative repercussions throughout the whole treating process.

The aim of the present invention is to obviate the above-described drawbacks and to improve the above described treating device in such a way as to dispose in a more simple and economic way the containers for restoring the single treating solutions. The attainment of the basic object of the present invention will emerge from the features described in the characterising portion of the independent claim.

Further embodiments and improvements according to the present invention are objects of the dependent claims.

The invention will be hereinafter described with reference to the accompanying drawing, wherein the only FIGURE shows in a schematic view a combination of a film processor with a paper-processor which in themselves are both made as a device according to the invention but they have some common components which are of secondary importance for the invention.

On the left side of the drawing are shown the traditional and the inventive components of the film processor. On the right side of the drawing are shown the traditional and the inventive components of the paper-processor. In the middle of the drawing are shown the common components of both processors.

The film-processor comprises three developing baths 1, 2, 3, one bleaching bath 4 two fixing baths 5, 6 and three stabilizing baths 7, 8, 9.

During the working operations, these nine treating baths contain respectively a developing solution, a bleaching solution, a fixing solution and a stabilizing solution as it is known in a traditional device for the chemical wet treatment of photographic film material.

In a similar way, the paper-processor comprises a developing bath 101, a bleaching/fixing bath 104 and four stabilizing baths 107, 108, 109, 110. During the working operations, these treating baths contain respectively a developing solution, a combined bleaching/fixing solution and a stabilizing solution as it is known in a traditional device for the chemical wet treatment of photographic reproducing material (paper for reproductions).

The photographic film or paper material to be chemically treated in a wet condition is guided to successively cross the various treating baths, beginning from a developing bath. Usually, the treating solutions and the number of the treating baths for the film material are different than those for the paper material.

The kind of the chemical treatment and the way of moving the photographic material across the treating baths are not subjects of the present invention and therefore they will not be further described.

In the film-processor there are six restoring containers 11–16, made of plastic material, for refilling the treating baths. Said restoring containers are grouped within two Similarly, in the paper-processor there are six restoring containers 111–116 made of plastic material and grouped within two cardboard casings 117–118.

Each casing 17 or 117 contains four restoring containers 11–14 or 111–114 for the developing solution and for the stabilizing solution, while the other casing 18–118 contains the restoring containers 15 and 16 or 115 and 116 for the bleaching solution and for the fixing solution (film) or the combined bleaching/fixing solution (paper).

Each restoring container 11–16 or 111–116 is provided with a level sensor (S1–S12) that senses the empty condition or the not-empty condition of the respective restoring container and transmits a signal to a driving device 50 that is connected with the level sensor in a not shown manner.

The restoring containers and the casings are of conventional type and they correspond to those used in the method described in the introductory part of the description.

The two processors share four further containers 21–24. The containers 21–23 are collection containers, while the container 24 is a water reservoir and it is also provided with a level sensor S13 connected with the driving device 50.

The restoring containers 11–16 or 111–116, the collection container 21–23 as well as the water reservoir 24 are connected with the treating baths 1–9 or 101–110 by means of two refilling pipes systems 31–37 or 131–136, 37 and an overflow pipes system 81–83.

As it is already known, the three pipes systems are designed in such a way that, on one side, the single treating baths result, each in turn, connected with the corresponding restoring containers by means of the refilling pipes. On the other side, the three pipes system are so designed that the overflow pipes, which are going out the developing baths, flow into the collection container 21 and that the overflow pipes which are going out the bleaching, fixing and stabilizing baths, flow into the collection containers 22, 23 making it possible to separate the solutions containing silver from the solutions which do not contain silver.

Since the stabilizing baths contain, as a rule, only a solution with a low silver content, their overflow pipes can also be connected to the collection container 21. As an alternative, the overflow pipes can also be connected in such a manner that the solutions having an high silver content are conveyed, for instance, into the collection container 22, while the solutions having a low silver content are conveyed into the collection container 23.

The refilling pipe 37, represented by broken lines, connects the water reservoir 24 with all the treating baths by means of a dispenser 57 in turn connected with the treating baths by means of respective pipes represented by broken lines.

In a known manner, the refilling pipes 31–36 and 131–136 are removably connected with the restoring containers 11–16 or 111–116 by means of fast couplings not shown in the drawing. Therefore, the restoring containers can be easily connected or disconnected with respect to the pipes.

In the refilling pipes 31–36 and 131–136 as well as in the refilling pipe 37 there are electric refilling pumps 41–46 or 141–146 and 147 connected, in a not shown manner, with the driving device 50.

These refilling pumps, under the control of the driving device 50, draw required quantities of treating solutions or of water from the single restoring containers 11–16 or 111–116 as well as from the water reservoir 24 and convey them into the single treating baths in order to fill again their levels.

The refilling process is stopped as soon as one of the level sensors S1–S6 or S7–S12 signals that the respective restoring containers is empty.

After which, both casings 17 and 18 housing the six restoring containers 11–16 of the film-processor or both casings 117–118 housing the six restoring containers 111–116 of the paper-processor are replaced by corresponding full casings or corresponding full restoring containers.

Up to this point, the film-processor and the paper-processor shown in the drawing correspond entirely, either from the structural or functional point of view, to the state of the art. Therefore, a person skilled in the art does not need further details. The inventive differences between the device according to the invention and the traditional treating devices will be hereinafter described.

According to the more essential feature of the invention, the restoring containers 11–13 or 111–113 holding developing solution are each connected with an additional pipe 61–63 or 161–163. Each additional pipe houses an auxiliary pump 71–73 or 171–173 which, in a not shown manner, is connected with the driving device 50.

The additional pipes 61–63 or 161–163 are connected with the lengths of the joining pipes 31–33 or 131–133 interposed between the refilling pumps 41–43 or 141–143 and the restoring containers 11–13 or 111–113. Therefore, the additional pipes are connected with the inlet side of the refilling pumps and lead to the collection container 21 holding the solutions without silver.

The main function of these auxiliary pumps is that to completely empty the restoring containers when it is necessary to draw the residual treating solutions from the restoring containers holding the developing solutions.

A further function of these auxiliary pumps is that to suck the air which is eventually penetrated into the lengths interposed between the refilling pumps and the restoring containers during the replacement of the casings or of the restoring containers, so avoiding that the air pockets cause damage to the precision of the refilling pumps out-lets.

When the driving device 50 receives from one of the level sensors S1–S12 the signal that a respective restoring container is empty, it carries out, in the first place, a reliability check out. For this purpose, the driving device 50 is connected with two material sensing elements or sensors S14 or S15, of known type and shown in a symbolic manner, which sense the quantity of photographic material crossing the treating baths of the film-processor or of the paper-processor.

If the quantity of material (film or paper) measured by the sensor is lower than the nominal quantity predetermined for the casings o for the restoring containers, and not more than a preset tolerance value, it is assumed that the restoring container in question is really empty and the process goes on operating the successive stages. Otherwise, it is assumed an error condition and it is requested the intervention of an operator.

Straight after, the residual quantities of the treating solution are drawn from all the restoring containers.

The less critical bleaching, fixing and stabilizing solutions are conveyed into the corresponding treating baths 4–9 or 104–110 by means of the refilling pumps 44–46 or 144–146 and under the control of the driving device 50.

The residual quantities of developing solutions in the restoring containers 11–13 or 111–113 are conveyed, by means of the auxiliary pumps 71–73 or 171–173 and under the control of the driving device, into the collection container 21 holding the solution without silver.

As an alternative, a certain quantity (a certain percentage of the developing bath volume) of these residual quantities of the developing solutions can be, in the first place, conveyed into the corresponding developing bath and the remaining quantity can be successively conveyed into the collection container.

When all the restoring containers are so completely emptied, the casings or the restoring containers can be removed from the film-processor or from the paper-processor and replaced by corresponding fill restoring containers.

Before restarting the working operation, the driving device 50 activates, first of all and for a short time, the auxiliary pumps 71–73 or 171–173 in order to suck the air which is eventually penetrated into the refilling pipes.

In the above described embodiment, the additional pipes and the corresponding auxiliary pumps are joined only to the restoring containers which are holding the developing solution.

It is well understood that such additional pipes and corresponding auxiliary pumps may also be employed for the remaining restoring containers, as an example for conveying the residual quantities of treating solutions into the collection container 21 instead of the corresponding treating baths, or for sucking the air bubbles out of the refilling pipes.

Moreover, it is easily understable that the residual quantities can be conveyed into suitable containers from which they can be eventually conveyed to a further use. According to a particularly advantageous improvement of the present invention, the refilling pumps 41–46 or 141–146 are made in such a known manner that they have a flow rate (volume of flowable material flowing per unit time) which can be varied by the driving device 50.

The driving device 50 is equipped with a program routine that,on the ground of the residual quantities drawn from the single restoring containers, it can determine a correcting value for adjusting the flow rates of the single refilling pumps as well as it can correspondingly correct the flow rates adjustments in such a way as to annul or at least reduce the residuals in the following used restoring containers and, then, to attain the object to empty at the same time all the restoring containers. Therefore, the refilling pumps and the driving device which is controlling the refilling pumps are more or less of self adapting or self taught type.

It is clear that such a correction of the pumps flow rates is not calculated on the ground of the residual quantities of a single series of restoring containers but it must be calculated on the ground of a statistic value resulting from the residuals quantities of a numerous series of restoring containers.

It is well understood that further modifications and variations may be made to the device forming the object of the present invention without departing however from what already described and hereinafter claimed with reference to the accompanying drawings and thence from the protection extent of the present industrial invention.

What is claimed is:

1. A device for the chemical wet treatment of photographic material comprising:

a plurality of treating baths that are successively crossed by the photographic material to be treated, said plurality of treating baths being adapted to contain, during working operations, photographic treating solutions selected from the group consisting of developing, bleaching, fixing and stabilizing solutions;

restoring containers containing photographic treating solutions selected from the group consisting of developing, bleaching, fixing and stabilizing solutions, said restoring containers having level sensors;

a water reservoir;

a system of pumps and pipes for drawing the treating solutions and treating water from said restoring containers and from said water reservoir and conveying the treating solutions and the treating water to said plurality of treating baths, wherein a refilling pump and a corresponding refilling pipe are provided for each of said restoring containers and for said water reservoir;

a driving device for driving each said refilling pump in a refilling process, said driving device being cooperatively associated with said level sensors of said restoring containers such that when one of said restoring containers is empty, the refilling process is stopped;

an auxiliary pump operable by said driving device and a corresponding additional pipe provided for each of at least one of said restoring containers containing photographic treating solutions such that photographic treating solution can be drawn from each of said at least one of said restoring containers by said auxiliary pump and said additional pipe.

2. The device of claim 1, wherein said driving device is for actuating said refilling pumps and said auxiliary pumps when one of said restoring containers becomes empty in order to remove residual treating solution from the one of said restoring containers.

3. The device of claim 1, wherein said driving device is for actuating said refilling pumps in order to empty at least one of said restoring containers that does not contain developing solution as a photographic treating solution and to convey the contents of said at least one of said restoring containers that does not contain developing solution into respective said treating baths.

4. The device of claim 2, wherein said additional pipe leads to a collection container and said driving device is for actuating said auxiliary pump in order to empty each of said at least one of said restoring containers containing developing solution as photographic treating solution and to convey the developing solution into said collection container.

5. The device of claim 2, wherein said additional pipe leads to a collection container and said driving device is for actuating said refilling pump and said auxiliary pump in order to empty each of said at least one of said restoring containers containing developing solution as photographic treating solution and to convey a portion of the developing solution into corresponding said treating baths with said refilling pump and convey a remaining portion of the contents of said at least one of said restoring containers containing developing solution as photographic treating solution into said collection container with said auxiliary pump.

6. The device of claim 1, wherein each said auxiliary pump is connected to a refilling pipe upstream of the corresponding refilling pump.

7. The device of claim 6, wherein said driving device is for actuating each said auxiliary pump after placement of fill said restoring containers for a short period of time in order to suction air bubbles out of a refilling pipe length upstream of the respective said refilling pump.

8. The device of claim 2, and further comprising a material sensing element, cooperatively associated with said driving device, for sensing a quantity of photographic material that has been treated beginning from when said restoring containers are full, wherein said driving device is for carrying out an emptying operation of said restoring containers when one of said restoring containers has been sensed to be empty if the quantity of photographic material sensed by said material sensing element is lower than a predetermined nominal quantity and not more than a preset tolerance value.

9. The device of claim 2, wherein each said refilling pump has a flow rate that can be varied by said driving device, said driving device adjusting the flow rate of each said refilling pump based on the residual treating solution to be drawn from said restoring containers and so as to avoid residual solution in said restoring containers.

10. The device of claim 1, wherein each said additional pipe is connected to a collection container.

* * * * *